United States Patent [19]

Gyongyosi et al.

[11] 3,965,998

[45] June 29, 1976

[54] DUST CONTROL HOOD AND DUST CONTROL SYSTEM

[75] Inventors: Laszlo Gyongyosi; Paul A. Lincoln, both of Clarksburg, W. Va.

[73] Assignee: Ingersoll-Rand Company, Woodcliff Lake, N.J.

[22] Filed: Dec. 19, 1974

[21] Appl. No.: 534,177

[52] U.S. Cl. ..... 175/209; 175/88

[51] Int. Cl.[2] ..... E21B 21/00

[58] Field of Search ..... 175/207, 220, 209–215, 175/85, 88, 52; 15/210 B

[56] References Cited

UNITED STATES PATENTS

| | | | |
|---|---|---|---|
| 1,816,324 | 7/1931 | Hansen | 175/207 |
| 2,041,689 | 5/1936 | Baumeister et al. | 175/209 X |
| 2,144,586 | 1/1939 | Kelley | 175/209 X |
| 2,590,958 | 4/1952 | Goodrich | 175/209 |
| 2,634,952 | 4/1953 | Brinkley | 175/209 |
| 2,712,921 | 7/1955 | Redman | 175/212 X |
| 2,781,185 | 2/1957 | Robbins | 175/85 X |
| 2,838,282 | 6/1958 | Colquitt | 175/209 X |
| 3,045,769 | 7/1962 | Feucht et al. | 175/220 X |
| 3,158,212 | 11/1964 | Fanshowe et al. | 175/85 |
| 3,800,890 | 4/1974 | Gyongyosi et al. | 175/213 X |

FOREIGN PATENTS OR APPLICATIONS

| | | | |
|---|---|---|---|
| 1,949,979 | 4/1971 | Germany | 175/209 |
| 184,212 | 9/1966 | U.S.S.R. | 175/209 |

*Primary Examiner*—Ernest R. Purser
*Assistant Examiner*—William F. Pate, III
*Attorney, Agent, or Firm*—Frank S. Troidl

[57] ABSTRACT

This dust control system is mounted on a drill tower. A housing with an open bottom is used for drawing air into the housing. A side air outlet is used for drawing the dust and chips from the housing to a skimmer. The housing is provided with a pair of longitudinally separated flexible seals with central holes adapted to flexibly receive the drill bit and drill string. The dust hood is movable longitudinally with respect to the drill tower so that the dust hood may be adjusted to a predetermined height above the top of the hole. The hood may be swung from a position aligned with the drill bit and drill string to a position laterally spaced from the side of the drill tower and vice-versa.

4 Claims, 7 Drawing Figures

DUST CONTROL HOOD AND DUST CONTROL SYSTEM

This invention relates to bore hole drilling. More particularly this invention is a new dust control system and a new dust control hood which can be used with the new dust control system.

Dust control systems are known for controlling the escape of dust during drilling operations. However, currently known dust control systems have certain disadvantages. For example, U.S. Pat. No. 2,144,586 granted to G. S. Kelly on Jan. 17, 1939, shows one type of dust control system. However, in the Kelly dust control system, the hood either has to be opened to get the bit and drill string in the hood; or the bit on the drill string has to be removed before the hood can be taken off the drill string. Also the hood shown by U.S. Pat. No. 2,144,586 was meant strictly for small sized drill rods and bits. With such small sized holes in the hood, one cannot use larger sized drill rods and bits such as an 8 inch diameter drill rod with a 10 inch diameter bit.

Our new dust control hood permits the driller to place the drill string with the bit attached right through the hood for drilling operations. The hood need not be opened and the bit need not be removed from the drill string. The superiority of such a hood becomes apparent when quick removal of the hood is required such as when the hole becomes wet and the hood should be removed quickly or the hole is finished and the bit and drill string must be retracted so that the machine on which the dust control hood is mounted can be moved to the next hole quickly.

Our superior dust control hood is achieved by providing the hood with a pair of longitudinally spaced flexible seals. Each flexible seal has a central hole. The seals are sufficiently flexible so that the holes expand to receive the drill bit and drill string of greater diameter than the normal diameter of the hole in each flexible seal. Thus, even though the hole in each flexible seal may be say 4½ inches in diameter, a bit with a diameter of approximately say 10 inches diameter may be fed through the top of the hood and through the holes in the longitudinally spaced flexible seals.

It is common practice to mount a drilling rig on a drill tower with the drill tower being mounted on a mobile truck or tractor. The drill tower is commonly constructed so that the tower may be pivoted to permit the rig to be used with the drill tower in a vertical position to drill vertical holes and in a tilted position to drill inclined holes. Thus, any efficient dust control system must be constructed so that the position of the hood above the bore hole is easily adjusted and controled for use in either the drilling of a vertical hole or the drilling of a tilted hole.

The position of the bottom of the hood above the ground surface is also quite important. If the hood is too far above ground, dust will escape around the bottom of the hood; however, if the hood is too close to the ground, an insufficient amount of outside air will be drawn into the hood. Thus, an efficient vertical adjusting mechanism to permit the longitudinal movement of the hood is quite necessary. Also, a mechanism must be provided to allow the hood to be out of alignment with the drill string when the drill string is not being used and/or the rig is being transported to a new location.

Our new dust control system for use with a drill tower includes a new and novel mechanism for moving the dust hood longitudinally with respect to the drill tower and also, if desired, for swinging the dust hood out of alignment with the drill string.

The invention as well as its many advantages may be further understood by reference to the following detailed description and drawings in which.

In the various figures, like parts are referred to by like numbers.

Figure 1:
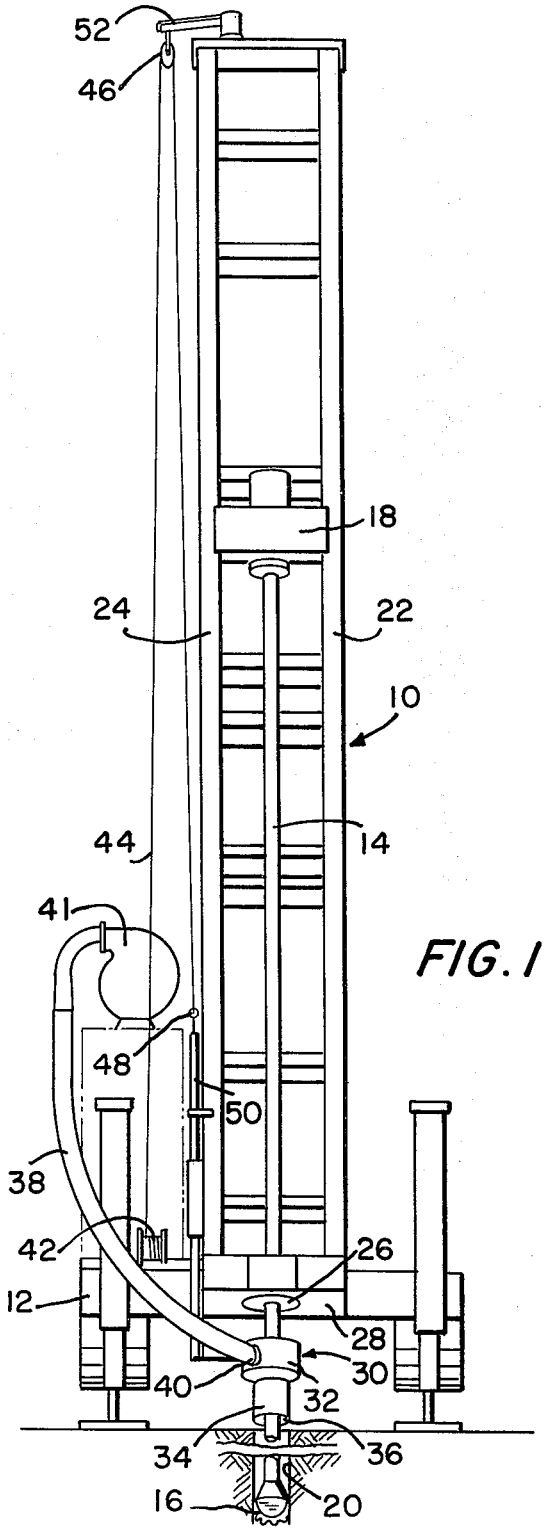
FIG. 1 is a front elevational view showing a mobile rig in a position to drill a vertical hole and showing the arrangement of our new dust control hood and dust control system.

Referring to the drawings, and more particularly to FIG. 1, a drill tower 10 is mounted on a tractor 12. A drill string 14 with a drill bit 16 attached to its bottom is rotated by a top powerhead 18 to drill the bore hole 20. The top powerhead and the drill string are movable along the guidebars 22 and 24 of drill tower 10. The mechanism for moving the top drive and the attached drill string is not shown in the drawings since such mechanism is well known to those skilled in the art.

As can be seen in FIG. 1, the drill bit 16 and drill string 14 has been inserted through a hole 26 in the drill tower front platform 28 and through our new dust hood 30 for drilling the bore hole 20. The dust hood 30 includes an upper portion 32 and a lower portion 34 of less diameter than the upper portion 32. An open bottom 36 is provided in the dust hood 30. The bottom 36 of the dust hood 30 is kept a predetermined distance above the top of the bore hole 20 for most efficient operation.

Figure 2:
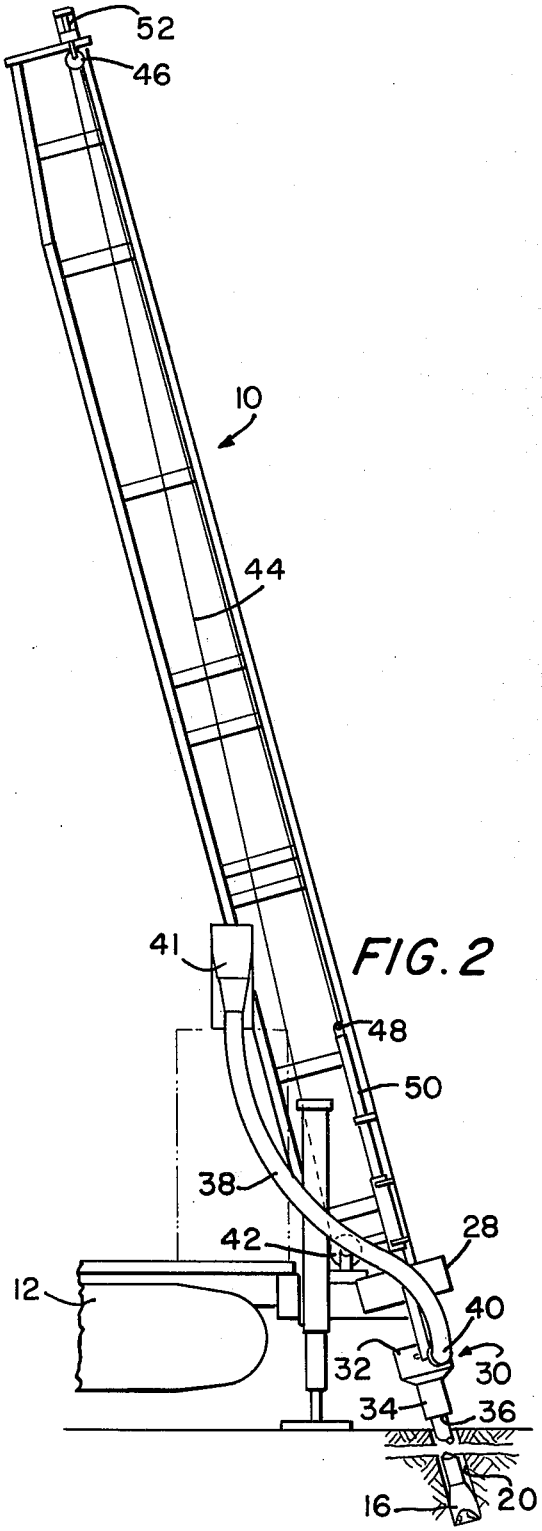
FIG. 2 is a side elevational view showing the drill tower in a tilted position for drilling an inclined bore hole.

A flexible hose 38 is connected to the side air outlet 40 in the dust hood 30 and leads to a skimmer 41 or other dust separating means where the dust is removed. FIG. 2 shows the drill tower in a tilted position for drilling an inclined bore hole. Note that the flexible hose 38 permits the operator to tilt the drill tower 10 without any previous removing or disconnecting the flexible hose 38. While tilting the drill tower it will probably be necessary to adjust the longitudinal position of the hood 30 with respect to the drill tower 10.

The means for raising or lowering the dust hood 30 includes a winch 42 mounted on the platform 12 and laterally spaced from the drill tower 10. A cable 44 is wound about the winch 42 and extends upwardly along side of the tower around a sheave 46, and downwardly to the eyebolt 48 of a rod 50. The sheave 46 is mounted on a pivotable boom 52 so that the cable 44 and attached equipment may be kept laterally spaced from the drill tower 10 during drilling operations and while the hood is being used.

Figure 4:
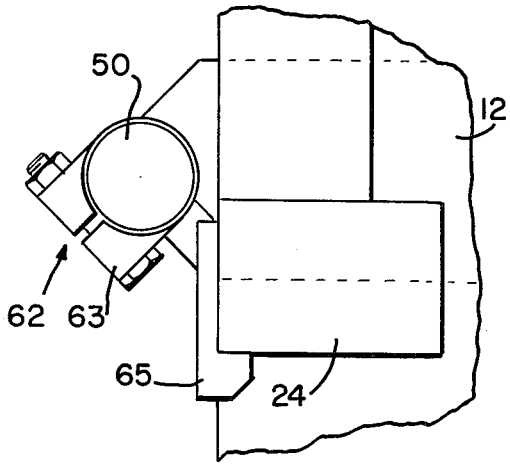
FIG. 4 is a view taken along lines 4—4 of FIG. 3.
Figure 3:
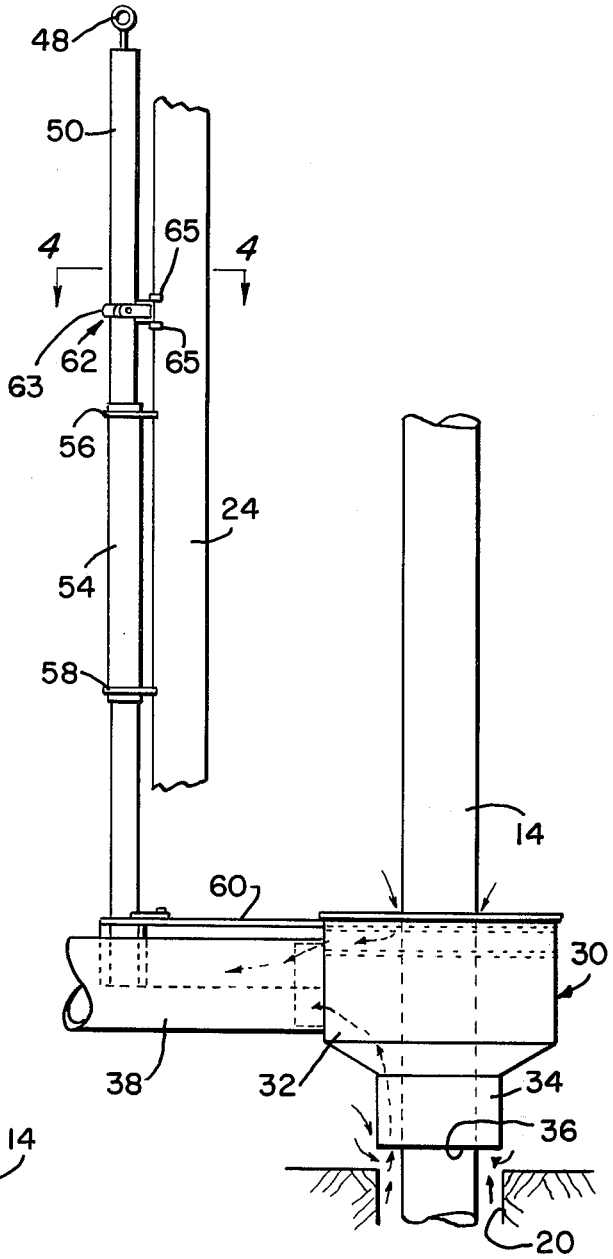
FIG. 3 is a fragmentary view on an enlarged scale illustrating a portion of the means for moving the dust hood longitudinally with respect to the drill tower.

As shown more clearly in FIG. 3, the rod 50 moves longitudinally within a rod support tube 54 mounted to the drill tower guide 24 by longitudinally separated brackets 56 and 58. The bottom of the longitudinally movable rod 50 is rigidly connected to a laterally extending member 60 which in turn is connected to the hood 30. The rod 50 may be easily turned so that the operator may manually swing the hood 30 from a position aligned with the bore hole 20 and the drill string 14 to a position out of alignment with the drill hole 20 and the drill string 14 and to the side of the drill tower 10.

referring to FIG. 3 and FIG. 4, a rod stop means 62 including a U-shaped portion 63 and a pair of stops 65, is connected to rod 50. The stops 65 are adapted to come into locking contact with guide 24 of the drill tower when the hood 30 is properly aligned with the drill bit and drill string.

Figure 5:
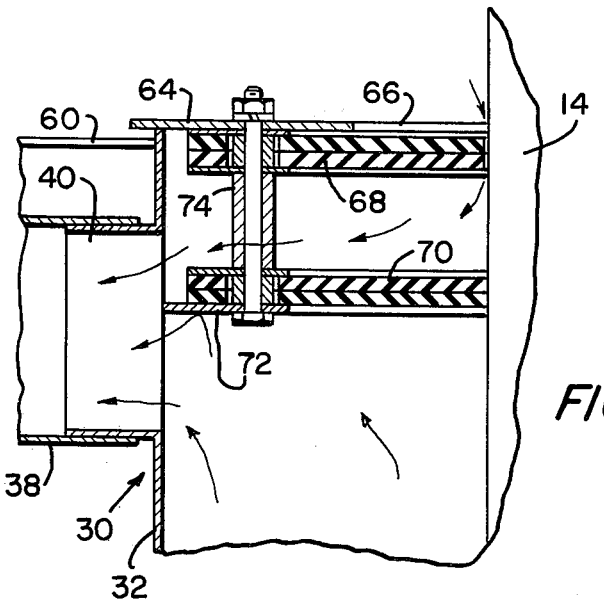
FIG. 5 is a sectional view on an enlarged scale showing the inner construction of the dust hood, including the longitudinally spaced flexible seals.
Figure 7:
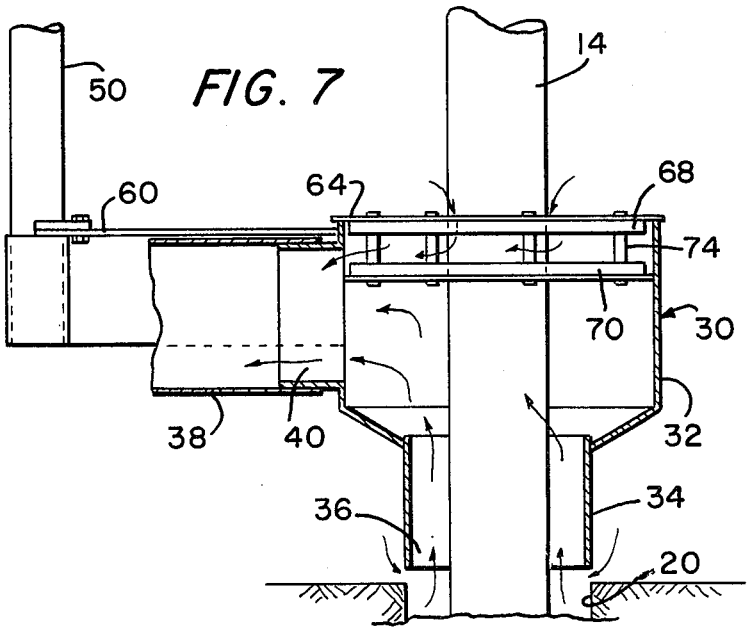
FIG. 7 is a fragmentary view, partly in section, showing the hood and means for connecting the hood to the longitudinally movable rod.

Referring to FIG. 5 and FIG. 7, the new dust control hood 30 includes a housing with a top plate 64 with a bore 66 adapted to receive the drill string 14. A first flexible seal 68 is mounted just below the top plate 64 and extends across the housing. A second flexible seal 70 is mounted on the annular plate 72. Each of the flexible seals 68 and 70 is provided with a central hole and the flexible seals are sufficiently flexible so that the holes expand to receive a drill bit and drill string of greater diameter than the normal diameter of the hole as the drill bit and drill string are lowered into the hood.

Figure 6:
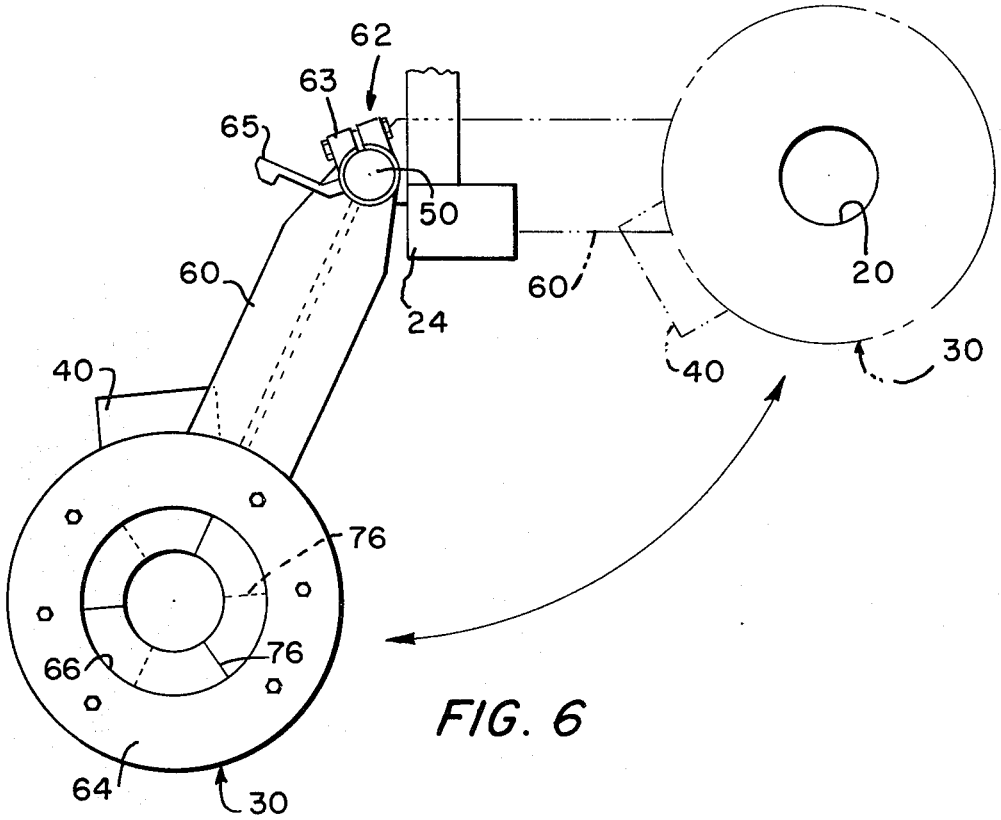
FIG. 6 is an enlarged view illustrating the position of the positive stop means when the hood is swung to a position laterally spaced from the drill tower.

Each flexible seal 68 and 70 may be a floating seal constructed similarly to the floating seal shown in U.S. Pat. No. 3,800,890, granted Apr. 2, 1974, to Gyongyosi et al. The seals are carried by dowels 74 and each seal is made up of a pair of compliant plastic sheets. Each plastic sheet has a plurality of radial slits 76 (see FIG. 6). To insure that dust is not freely passed through the slits 76, one of the compliant plastic sheets is rotated so that the slits of the one are not aligned with the slits of the other.

Note that the top flexible seal 68 extends across the the hood 30, near the top of the hood and above the air outlet 40. The lower flexible seal 70 extends across the hood 30 at a point below the top of the outlet 40 and above the bottom of air outlet 40. Thus, air entering the annular space between the two flexible seals may be pumped from this annular space out through the air outlet 40.

In operation, air at a high velocity is blown downwardly through the drill string 14 and bit 16 during the drilling of the bore hole. The high velocity air entering the bore hole lifts the cuttings and dust from the hole which enter the dust hood 30. The CFM air in the flexible hose 38 is greater than the CFM air coming out of the drill hole thus carrying the cuttings to the skimmer 41. Additional or makeup air is pulled into the hood 30 from the bottom 36 and also through the bore in the top flexible seal 68. The hood 30 can be raised or lowered from a remote control station in the operator's cab to the proper functional height above the ground to allow enough air to prevent dust blowing out of the bottom of the hood and also allow enough makeup air for the suction applied to flexible hose 38. The hood is effective for both angle drilling or vertical drilling by virtue of its being connected to the drill tower and parallel to the drill steel. The hood may be swung away from alignment with the drill string and raised along side of the tower for greater ground clearance when the mobile unit is moved from one bore hole to another bore hole. The floating seal 68 near the top of the hood permits clean air to enter from the top and the lower floating seal 70 prevents dust from shooting out of the top.

We claim:

1. A dust control hood for use in drilling holes comprising: a housing with an open bottom; a first flexible seal extending across the housing; a second flexible seal in the housing longitudinally spaced from the first flexible seal to provide air passage means in said longitudinal space, each of said flexible seals having a central hole; the flexible seals being sufficiently flexible so that the holes expand to receive a drill bit and drill string of greater diameter than the normal diameter of the hole in each flexible seal as the drill bit and drill string are lowered into the housing; and an air outlet extending from the side of the housing, the first flexible seal being above the air outlet and the second flexible seal extending across the housing at a point below the top of the air outlet and above the bottom of the air outlet, said air passage means providing direct air flow from the annular space between the two flexible seals to the air outlet so that air entering the annular space through the top of the housing and between the two flexible seals may be pumped from said annular space out through the air outlet, and also so that additional air may be pulled into the open bottom of the housing through the air outlet.

2. A dust control system for use in controlling dust while drilling bore holes comprising: a drill tower, a housing having an open bottom air inlet, a side air outlet, and a pair of longitudinally separated flexible seals to provide air passage means in said longitudinal space, each having a central hole adapted to flexibly receive the drill string, the first flexible seal being above the air outlet, and the second flexible seal extending across the housing at a point below the top of the air outlet and above the bottom of the air outlet, said air passage means providing direct air flow from the annular space between the two flexible seals to the air outlet so that air entering the annular space through the top of the housing and between the two flexible seals may be pumped from said annular space out through the air outlet, and also so that additional air may be pulled into the open bottom of the housing through the air outlet; a flexible hose connected to the air outlet and leading to a dust separator system; and means movable longitudinally with respect to the drill tower and connected to the housing so that the housing may be adjusted to a predetermined height above the top of the hole.

3. A dust control system in accordance with claim 2 wherein: the longitudinally movable means comprises: an extension connected to the housing and extending laterally from the housing; and a longitudinally movable rotatable rod member connected to the extension.

4. A dust control system for use in controlling dust while drilling holes comprising: a drill tower; a housing having an open bottom air inlet, a side air outlet and a pair of longitudinally separated flexible seals, to provide air passage means in said longitudinal space, each of said flexible seals having central holes adapted to flexibly receive the drill string, the first flexible seal being above the air outlet, and the second flexible seal extending across the housing at a point below the top of the air outlet and above the bottom of the air outlet, said air passage means providing direct air flow from the annular space between the two flexible seals to the air outlet so that air entering the annular space through the top of the housing and between the two flexible seals may be pumped from said annular space out through the air outlet, and also so that additional air may be pulled into the open bottom of the housing through the air outlet; a flexible hose connected to the air outlet and leading to a dust separator; a winch on the floor of the tower; sheave means on the top of the tower; a cable extending from the winch and around the sheave means, a rotatable rod connected to the end of the cable; and a laterally extending member connected to the rod and to the housing.

* * * * *